US005345917A

United States Patent [19]

Maruyama et al.

[11] Patent Number: 5,345,917

[45] Date of Patent: Sep. 13, 1994

[54] EVAPORATIVE FUEL-PROCESSING SYSTEM FOR INTERNAL COMBUSTION ENGINES FOR VEHICLES

[75] Inventors: Hiroshi Maruyama; Masayoshi Yamanaka, both of Wako, Japan

[73] Assignee: Honda Giken Kogyo Kabushiki Kaisha, Tokyo, Japan

[21] Appl. No.: 85,168

[22] Filed: Jul. 2, 1993

[30] Foreign Application Priority Data

Jul. 24, 1992 [JP] Japan ..... 4-218629

[51] Int. Cl.[5] ..... F02M 37/04

[52] U.S. Cl. ..... 123/520; 123/198 D

[58] Field of Search ..... 123/520, 519, 516, 518, 123/521, 198 D

[56] References Cited

U.S. PATENT DOCUMENTS 4,926,825 5/1990 Ohtaka ..... 123/520
4,949,695 8/1990 Uranishi ..... 123/520
5,143,035 9/1992 Kayanuma ..... 123/520
5,150,689 9/1992 Yano ..... 123/520
5,158,059 10/1992 Kuroda ..... 123/520
5,191,870 3/1993 Cook ..... 123/520

FOREIGN PATENT DOCUMENTS 5-79408 3/1993 Japan .

*Primary Examiner*—Carl S. Miller
*Attorney, Agent, or Firm*—Nikaido, Marmelstein, Murray & Oram

[57] ABSTRACT

An evaporative fuel-processing system for an internal combustion engine in a vehicle, comprises an evaporative emission control system. A purge control valve is arranged across a purging passage for controlling opening thereof, and a drain shut valve is arranged across an inlet port of a canister. The evaporative fuel-processing system has a function of detecting abnormalities in the evaporative control system and the fuel tank. The ECU detects an amount of evaporative fuel generated within the fuel tank, and inhibits the abnormality detection of the evaporative control system, when the amount of generated evaporative fuel exceeds a predetermined value.

8 Claims, 8 Drawing Sheets

Furthermore, in such a case, even if the negative pressurization of the tank is continued, the pressure cannot be reduced to a desired value due to an increased air flow resistance of the canister which acts against a drawing force caused by vacuum in the intake passage. Therefore, there has been the danger of a misjudgment that leakage has occurred, or the determination has to be suspended.

SUMMARY OF THE INVENTION

It is the object of the invention to provide an evaporative fuel-processing system for an internal combustion engine for vehicles, which is capable of accurately detecting abnormalities in an evaporative emission control system of the engine to thereby avoid degraded driveability and exhaust gas emission characteristics of the engine.

To attain the object, the present invention provides an evaporative fuel-processing system for an internal combustion engine in a vehicle and having an intake system, and a fuel tank, the evaporative fuel-processing system including an evaporative emission control system comprising a canister having an air inlet port communicating with the atmosphere, an evaporative fuel-guiding passage extending between the canister and the fuel tank, a purging passage extending between the canister and the intake system, a purge control valve arranged across the purging passage for controlling opening thereof, a drain shut valve arranged across the inlet port of the canister, control means for controlling operations of the purge control valve and the drain shut valve, and abnormality detecting means for detecting abnormality in the evaporative emission control system and the fuel tank while operations of the purge control valve and the drain shut valve are controlled by the control means.

The evaporative fuel-processing system according to the invention is characterized by comprising:

evaporative fuel amount detecting means for detecting an amount of evaporative fuel generated within the fuel tank; and abnormality detection inhibiting means for inhibiting abnormality detection by the abnormality detecting means when the amount of evaporative fuel generated within the fuel tank detected by the evaporative fuel amount detecting means exceeds a predetermined value.

Preferably, the evaporative fuel amount detecting means detects the amount of the evaporative fuel generated within the fuel tank, based on a change in pressure within the fuel tank.

Also preferably, the abnormality detecting means includes open-to-atmosphere setting means for bringing the interior of the evaporative control system and the fuel tank into a state open to the atmosphere, and pressure checking means for closing at least the fuel tank after the evaporative control system and the fuel tank have been brought into the open state and for checking a change in pressure within the fuel tank while the fuel tank is closed, the amount of the evaporative fuel generated within the fuel tank being detected based on the checked change in pressure within the fuel tank.

Further preferably, the abnormality detecting means includes negative pressurization means responsive to a command from the control means for bringing at least one of the evaporative emission control system and the fuel tank into a predetermined negatively pressurized state by controlling operations of the purge control valve and the drain shut valve, and the abnormality detection inhibiting means inhibits execution of the negative pressurization means when the amount of the evaporative fuel generated within the fuel tank detected by the evaporative fuel amount detecting means exceeds the predetermined value.

Further preferably, the abnormality detecting means includes pressure change detecting means for detecting a change in pressure within the at least one of the evaporative emission control system and the fuel tank, after the at least one of the evaporative emission control system and the fuel tank have been brought into the predetermined negatively pressurized state.

Alternatively of detecting the generated evaporative fuel amount based upon a change in pressure within the fuel tank, the engine includes an exhaust system, and oxygen concentration detecting means for detecting concentration of oxygen in exhaust gases in the exhaust system, and the amount of the evaporative fuel generated within the fuel tank is detected in accordance with the concentration of oxygen detected by the oxygen concentration detecting means, when the purging passage is opened by the purge control valve controlled by the control means.

The above and other objects, features, and advantages of the invention will become more apparent from the following detailed description taken in conjunction with the accompanying drawings.

DETAILED DESCRIPTION

The invention will be described in detail with reference to the drawings showing embodiments thereof.

Figure 1:
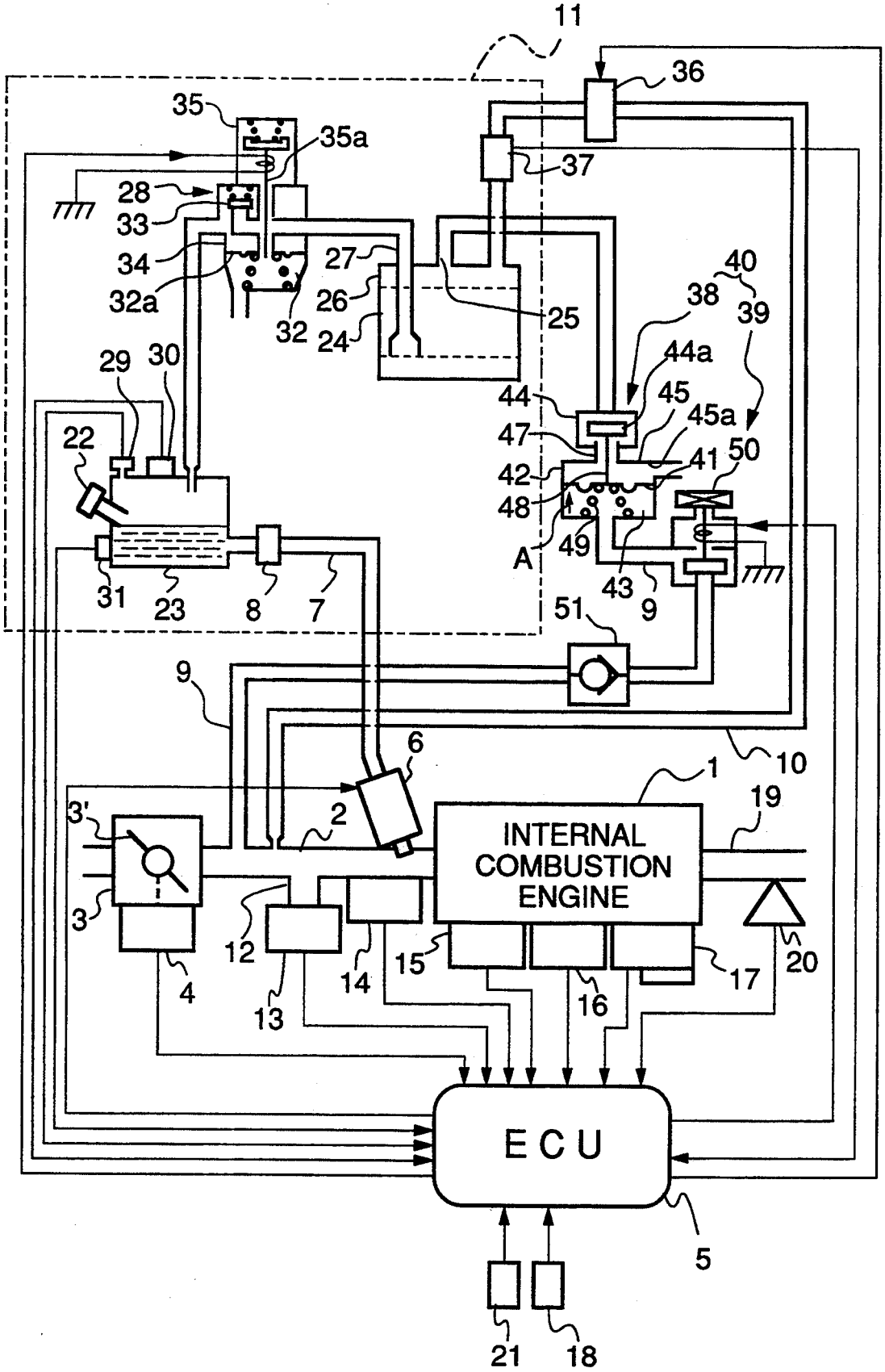
FIG. 1 is a block diagram showing the whole arrangement of an internal combustion engine and an evaporative fuel-processing system therefor, according to an embodiment of the invention.

Referring first to FIG. 1, there is illustrated the whole arrangement of an internal combustion engine installed in an automotive vehicle and an evaporative fuel-processing system therefor according to an embodiment of the invention.

In the figure, reference numeral 1 designates an internal combustion engine (hereinafter referred to as "the

EVAPORATIVE FUEL-PROCESSING SYSTEM FOR INTERNAL COMBUSTION ENGINES FOR VEHICLES

BACKGROUND OF THE INVENTION

1. Field of the Invention

This invention relates to an evaporative fuel-processing system for internal combustion engines installed in vehicles, and more particularly to an evaporative fuel-processing system which has a function of detecting abnormalities in an evaporative emission control system wherein evaporative fuel generated in a fuel tank of the engine is purged to an intake system thereof.

2. Prior Art

Conventionally, there has been widely used an evaporative fuel-processing system for internal combustion engines installed in automotive vehicles, which comprises an evaporative emission control system (hereinafter referred to as "the emission control system") having a canister provided with an air inlet port, a first control valve arranged across an evaporative fuel guiding passage extending between the canister and the fuel tank of the engine, and a second control valve arranged across a purging passage extending between the canister and an intake system of the engine.

An evaporative fuel-processing system of this kind temporarily stores evaporative fuel in the canister, and then purges the evaporative fuel into the intake system of the engine.

Whether or not an evaporative fuel-processing system of this kind is normally operating can be checked, for example, by forcibly bringing the emission control system into a predetermined negatively pressurized state, and then measuring a change in pressure within the fuel tank hereinafter referred to as "the tank internal pressure") occurring with the lapse of time after the system has been brought into the predetermined negatively pressurized state to thereby determine abnormality of the evaporative fuel-processing system. In this connection, reference is made to Japanese Provisional Patent Publication Kokai) No. 5-79408 and its corresponding U.S. Ser. No. 07/942,875 assigned to the assignee of the present application, in which is proposed an abnormality determining method of this kind.

More specifically, according to the method of the publication, there are successively carried out (1) an open-to-atmosphere process of the emission control system, which relieves the emission control system to the atmosphere, (2) a check of a change in tank internal pressure, which measures a rate of change in the tank internal pressure while the fuel tank is closed, (3) a process of reducing tank internal pressure, which negatively pressurizes the emission control system to a desired pressure value by the use of negative pressure from the intake system of the engine, and (4) a leak down check, which checks pressure recovering from the desired negative pressure to thereby determine whether or not leakage has occurred in the emission control system.

Further, in the system of the above-mentioned publication, a correction processing is carried out in order to prevent any misjudgment on leak check ascribable to various operating conditions of the fuel tank.

Specifically, if in bringing the emission control system into a negatively pressurized state by reducing the tank internal pressure as mentioned above, a rate of decrease in the pressure varies depending upon various operating conditions of the fuel tank, e.g. a fuel amount within the fuel tank, fuel temperature, and tank internal pressure under an open-to-atmosphere condition, so that a time period over which the tank internal pressure reaches a predetermined abnormality determination value varies, and hence the accuracy of abnormality determination is degraded.

More specifically, when the fuel tank is almost filled with fuel, the spatial volume at an upper portion of the fuel tank is small to increase the decrease rate of the tank internal pressure, whereas, when the amount of fuel within the fuel tank is small, the decrease rate of the pressure is low. Accordingly, there is the danger of a misjudgment, depending on the fuel amount within the fuel tank. Further, if the negative pressurization requires a long time period to complete, the leak down check also requires a long time period to complete as well. Therefore, it is necessary to correct the time period over which the negative pressurization is to be carried out. Still further, a high fuel temperature causes generation of a large amount of evaporative fuel within the fuel tank, resulting in a low rate of decrease in the tank internal pressure. Thus, there is also the danger of a misjudgment. Moreover, when the tank internal pressure is high under the open-to-atmosphere condition, if evaporative fuel is leaked during the negative pressurization, it takes a long time period for the tank internal pressure to lower to the predetermined abnormality determination value. Thus, there is also the danger of a misjudgment on the abnormality.

To avoid the above misjudgments, according to the method of the publication, the time period over which the tank internal pressure reaches the abnormality determination value is corrected according to various conditions of the fuel tank.

Further, to improve the publication method, another method has been proposed by the present assignee in Japanese Patent Application No. 3-360629 and its corresponding U.S. Ser. No. 07/942,875, wherein it is determined whether or not the emission control system is abnormal when a predetermined time period has elapsed during negative pressurization, i.e. before the latter is completed. According to this method, even when the emission control system cannot be brought into a predetermined negatively pressurized state during the negative pressurization due to a perforation in the fuel tank or the like, the abnormality determination can be carried out.

However, the above-mentioned conventional evaporative fuel-processing systems have the following disadvantages:

First, when the amount of evaporative fuel generated in the fuel tank is extremely large, as in the case where the fuel tank is placed under a high temperature condition for a long time period, so that it exceeds a limit value for correction of the above-mentioned time period, the correction cannot be effective to thereby cause a misjudgment.

Secondly, under such a high temperature condition where evaporative fuel is easily generated, a large amount of evaporative fuel is stored in the canister, and consequently, the evaporative fuel is directly drawn into the intake system of the engine during the negative pressurization of the fuel tank, resulting in extreme enrichment of an air-fuel mixture supplied to the engine, and hence an adverse effect being exerted on the driveability and exhaust emission characteristics of the engine.

engine") having four cylinders, not shown, for instance. Connected to the cylinder block of the engine 1 is an intake pipe 2 across which is arranged a throttle body 3 accommodating a throttle-valve 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3' and slightly upstream of respective intake valves, not shown. The fuel injection valves 6 are connected to a fuel pump 8 via a fuel supply pipe 7, and electrically connected to the ECU 5 to have their valve opening periods controlled by signals therefrom.

A negative pressure communication passage 9 and a purging passage 10 open into the intake pipe 2 at respective locations downstream of the throttle valve 3', both of which are connected to an evaporative emission control system 11, referred to hereinafter.

Further, an intake pipe absolute pressure (PBA) sensor 13 is provided in communication with the interior of the intake pipe 2 via a conduit 12 opening into the intake pipe 2 at a location downstream of an end of the purging passage 10 opening into the intake pipe 2 for supplying an electric signal indicative of the sensed absolute pressure PBA within the intake pipe 2 to the ECU 5.

An intake air temperature (TA) sensor 14 is inserted into the intake pipe 2 at a location downstream of the conduit 12 for supplying an electric signal indicative of the sensed intake air temperature TA to the ECU 5.

An engine coolant temperature (TW) sensor 15 formed of a thermistor or the like is inserted into a coolant passage filled with a coolant and formed in the cylinder block, for supplying an electric signal indicative of the sensed engine coolant temperature TW to the ECU 5.

An engine rotational speed (NE) sensor 16 is arranged in facing relation to a camshaft or a crankshaft of the engine 1, neither of which is shown. The engine rotational speed sensor 16 generates a pulse as a TDC signal pulse at each of predetermined crank angles whenever the crankshaft rotates through 180 degrees, the pulse being supplied to the ECU 5.

A transmission 17 is connected between wheels of the vehicle, not shown, and an output shaft of the engine 1, for transmitting power from the engine 1 to the wheels.

A vehicle speed (VSP) sensor 18 is mounted on one of the wheels, for supplying an electric signal indicative of the sensed vehicle speed VSP to the ECU 5.

An oxygen concentration ($O_2$) sensor 20 is inserted into an exhaust pipe 19 extending from the engine 1, for supplying an electric signal indicative of the sensed oxygen concentration to the ECU 5.

An ignition switch (IGSW) sensor 21 detects an ON (or closed) state of an ignition switch IGSW, not shown, to detect that the engine 1 is in operation, and supplies an electric signal indicative of the ON state of the ignition switch IGSW to the ECU 5.

The engine 1 is provided with a fuel tank 23, which has mounted thereon a filter cap 22 which is removed for refueling.

The evaporative emission control system (hereinafter referred to as "the emission control system") 11 is comprised of a canister 26 containing activated carbon 24 as an adsorbent and having an air inlet port 25 provided in an upper wall thereof, an evaporative fuel-guiding passage 27 connecting between the canister 26 and the fuel tank 23, and a first control valve 28 arranged across the evaporative fuel-guiding passage 27.

The fuel tank 23 is connected to the fuel injection valves 6 via the fuel pump 8 and the fuel supply pipe 7, and has a tank internal pressure (PT) sensor (hereinafter referred to as "the PT sensor") 29 and a fuel amount (FV) sensor 30, both mounted at an upper wall thereof, and a fuel temperature (TF) sensor 31 as a tank temperature-detecting means mounted at a lateral side wall thereof. The PT sensor 29, the FV sensor 30, and the TF sensor 31 are electrically connected to the ECU 5. The PT sensor 29 senses pressure (tank internal pressure) PT within the fuel tank 23 and supplies an electric signal indicative of the sensed tank internal pressure PT to the ECU 5. The FV sensor 30 senses the volumetric amount of fuel within the fuel tank 23 and supplies an electric signal indicative of the sensed volumetric amount of fuel to the ECU 5. The TF sensor 31 senses the temperature of fuel within the fuel tank 23 and supplies an electric signal indicative of the sensed fuel temperature TF to the ECU 5.

The first control valve 28 is comprised of a two-way valve 34 formed of a positive pressure valve 32 and a negative pressure valve 33, and a first electromagnetic valve 35 formed in one body with the two-way valve 34. More specifically, the first electromagnetic valve 35 has a rod **35*a*, a front end of which is fixed to a diaphragm 32*a* of the positive pressure valve 32. Further, the first electromagnetic valve 35 is electrically connected to the ECU 5 to have its operation controlled by a signal supplied from the ECU 5. When the first electromagnetic valve 35 is energized, the positive pressure valve 32 of the two-way valve 34 is forcibly opened to open the first control valve 28, whereas when the first electromagnetic valve 35 is deenergized, the valving (opening/closing) operation of the first control valve 28 is controlled by the two-way valve 34** alone.

A purge control valve (second control valve) 36 is arranged across the purging passage 10 extending from the canister 26, which valve has a solenoid, not shown, electrically connected to the ECU 5. The purge control valve 36 is controlled by a signal supplied from the ECU 5 to linearly change the opening thereof. That is, the ECU 5 supplies a desired amount of control current to the purge control valve 36 to control the opening thereof.

A hot wire-type flowmeter (mass flowmeter) 37 is arranged in the purging passage 10 at a location between the canister 26 and the purge control valve 36. The flowmeter 37 has a platinum wire, not shown, which is heated by an electric current and cooled by a gas flow flowing in the purging passage 10 to have its electrical resistance reduced. The flowmeter 37 has an output characteristic variable in dependence on the concentration and flow rate of evaporative fuel flowing in the purging passage 10 as well as on the flow rate of a mixture of evaporative fuel and air being purged through the purging passage 10. The flowmeter 37 is electrically connected to the ECU 5 for supplying the same with an electric signal indicative of the flow rate of the mixture purged through the purging passage 10.

A drain shut valve 38 is mounted across the negative pressure communication passage 9 connecting between the air inlet port 25 of the canister 26 and the intake pipe 2, and a second electromagnetic valve 39 is mounted across the negative pressure communication passage 9 at a location downstream of the drain shut valve 38, the drain shut valve 38 and the second electromagnetic valve 39 constituting a third control valve 40.

The drain shut valve 38 has an air chamber 42 and a negative pressure chamber 43 defined by a diaphragm 41. Further, the air chamber 42 is formed of a first chamber 44 accommodating a valve element 44*a*, a second chamber 45 formed with an air introducing port 45*a*, and a narrowed communicating passage 47 connecting the second chamber 45 with the first chamber 44. The valve element 44*a* is connected via a rod 48 to the diaphragm 41. The negative pressure chamber 43 communicates with the second electromagnetic valve 39 via the communication passage 9, and has a spring 49 arranged therein for resiliently urging the diaphragm 41 and hence the valve element 44*a* in the direction indicated by an arrow A.

The second electromagnetic valve 39 is constructed such that when a solenoid thereof is deenergized, a valve element thereof is in a seated position to allow air to be introduced into the negative pressure chamber 43 via an air inlet port 50, and when the solenoid is energized, the valve element is in a lifted position in which the negative pressure chamber 43 communicates with the intake pipe 2 via the communication passage 9. In addition, reference numeral 51 indicates a check valve.

The ECU 5 constitutes the evaporative fuel-processing system in cooperation with the first control valves 28, the purge control valve 36, the drain shut valve 38, etc.

The ECU 5 comprises an input circuit having the functions of shaping the waveforms of input signals from various sensors, shifting the voltage levels of sensor output signals to a predetermined level, converting analog signals from analog-output sensors to digital signals, and so forth, a central processing unit (hereinafter called "the CPU"), memory means storing programs executed by the CPU and for storing results of calculations therefrom, etc., and an output circuit which outputs driving signals to the fuel injection valves 6, the first and second electromagnetic valves 35, 39, and the purge control valve 36.

The CPU determines various engine operating conditions, such as a feedback control operating regions and an open-loop control operating regions in response to an oxygen concentration in exhaust gases, based on the various engine parameter signals. Further, the CPU calculates a fuel injection time period TOUT of the fuel injection valves 6 actuated in synchronism with the generation of the TDC signal pulses according to the engine operating conditions, by using the following equation (1):

$$TOUT = Ti \times KO_2 \times K_1 + K_2 \quad (1)$$

where Ti represents a basic value of the fuel injection period TOUT, which is read from a Ti map according to the engine rotational speed NE and the intake pipe absolute pressure PBA.

$KO_2$ represents an air-fuel ratio correction coefficient which is set according to the oxygen concentration in exhaust gases detected by the $O_2$ sensor 20 during a feedback control mode, and to predetermined values when the engine is in the above-mentioned open-loop control regions, respectively. The correction coefficient $KO_2$ is calculated by executing a proportional control, i.e. by adding or subtracting a known proportional term (P term) when an output level from the $O_2$ sensor 20 is inverted. On the other hand, so long as the output level is not inverted, the coefficient $KO_2$ is calculated by executing an integral control, i.e. by adding or subtracting a known integral term (I term).

$K_1$ and $K_2$ represent other correction coefficients and correction variables, respectively, which are calculated according to engine operating parameters, and are set to such predetermined values as optimize engine operating characteristics, such as fuel consumption and engine accelerability.

The CPU supplies driving signals 6 to the fuel injection valves 6 via the output circuit, based on the fuel injection period TOUT obtained as above.

Figure 2:
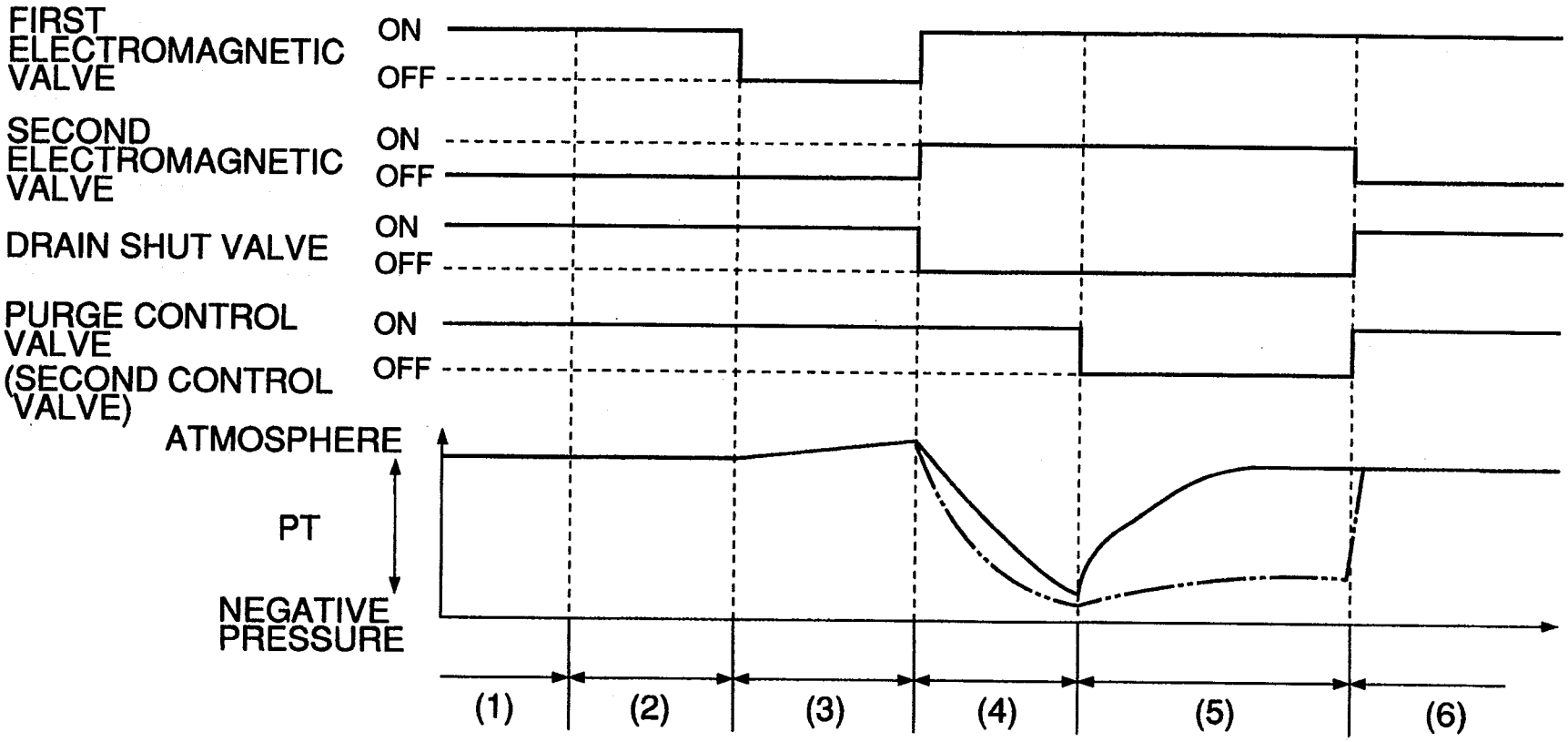
FIG. 2 is a timing chart showing operating patterns of first and second electromagnetic valves, a drain shut valve, and a purge control valve, all appearing in FIG. 1.

FIG. 2 shows operating patterns of the first and second electromagnetic valves 35 and 39, drain shut valve 38, and second control valve 36, as well as changes in the tank internal pressure PT caused by operations of the valves. Operation according to the operating patterns is executed by signals from the ECU 5 (CPU).

First, during normal operation (normal purging) of the engine, as indicated by a time period (1) in FIG. 2, the first electromagnetic valve 35 is energized and at the same time the second magnetic valve 39 is deenergized. When the ignition switch IGSW is closed and the engine is detected to be operating, by the IGSW sensor 18, the purge control valve 36 is energized to be opened. Then, evaporative fuel generated within the fuel tank 23 is allowed to flow through the evaporative fuel-guiding passage 27 into the canister 26 to be temporarily adsorbed by the adsorbent 24. Since the second electromagnetic valve 39 is deenergized as mentioned above, the drain shut valve 38 is open to allow fresh air to be introduced into the canister 26 through the air inlet port 45*a* so that evaporative fuel flowing into and stored in the canister 26 is purged together with fresh air through the second control valve 36 into the purging passage 10. On this occasion, if the fuel tank 23 is cooled due to ambient air, etc., negative pressure is developed within the fuel tank 23, which causes the negative pressure valve 33 of the two-way valve 34 to be opened so that part of the evaporative fuel in the canister 26 is returned through the two-way valve 34 into the fuel tank 23.

When predetermined abnormality determining conditions, hereinafter described, are satisfied, the first and second electromagnetic valves 35, 39, and the purge control valve 36 are operated in the following manner to carry out an abnormality detection of the evaporative control system 11.

First, the tank internal pressure PT is relieved to the atmosphere, over a time period (2) in FIG. 2. More specifically, the first electromagnetic valve 35 is held in the energized state to maintain communication between the fuel tank 23 and the canister 26, and at the same time the second electromagnetic valve 39 is held in the deenergized state to keep the drain shut valve 38 open. Further, the purge control valve 36 is held in the energized state or opened, to relieve the tank internal pressure PT to the atmosphere.

Then, an amount of change in the tank internal pressure PT is measured over a time period (3) in FIG. 2.

More specifically, the second electromagnetic valve 39 is held in the deenergized state to keep the drain shut valve 38 open, and at the same time the purge control valve 36 is kept open. However, the first electromagnetic valve 35 is turned off into the deenergized state, to thereby measure an amount of change in the tank internal pressure PT occurring after the fuel tank 23 has ceased to be open to the atmosphere for the purpose of checking an amount of evaporative fuel generated in the fuel tank 23. When the thus measured rate of change in the tank internal pressure exceeds a predetermined value, abnormality detection of the emission control system 11 is inhibited, as described hereinbelow.

Then, the evaporative control system 11 is negatively pressurized over a time period (4) in FIG. 2. More specifically, the first electromagnetic valve 35 and the purge control valve 36 are held in the energized state, while the second electromagnetic valve 39 is turned on to close the drain shut valve 38, whereby the evaporative control system 11 is negatively pressurized by a gas drawing force developed by negative pressure in the purging passage 10 held in communication with the intake pipe 2.

Then, a leak down check is carried out over a time period (5) in FIG. 2.

More specifically, after the evaporative control system 11 is negatively pressurized to a predetermined degree, i.e. after the predetermined negatively-pressurized condition of the system is established, the purge control valve 36 is closed, and then a change in the tank internal pressure PT occurring with the lapse of time thereafter is checked by the PT sensor 29. If the system 11 does not suffer from a significant leak of evaporative fuel therefrom, and hence the result of the leak down check shows that there is no substantial change in the tank internal pressure PT as indicated by the two-dot-chain line in the figure, it is determined that the evaporative control system 11 is normal, whereas if the system 11 suffers from a significant leak of evaporative fuel therefrom, and hence the result of the leak down check shows that there is a significant change in the tank internal pressure PT toward the atmospheric pressure as indicated by the solid line, it is determined that the emission control system 11 is abnormal. If the emission control system 11 does not become the predetermined negatively pressurized state within a predetermined time period, the leak down check is not carried out, as described hereinbelow.

After determining whether or not the system 11 is abnormal, the system 11 returns to the normal purging mode, as indicated by a time period (6) in FIG. 2.

More specifically, while the first electromagnetic valve 35 is held in the energized state, the second electromagnetic valve 39 is deenergized and the purge control valve 36 is opened, to thereby perform normal purging of evaporative fuel. In this state, the tank internal pressure PT is relieved to the atmosphere and hence becomes substantially equal to the atmospheric pressure.

Next, the manner of abnormality detection of the evaporative control system 11 will be described.

Figure 3:
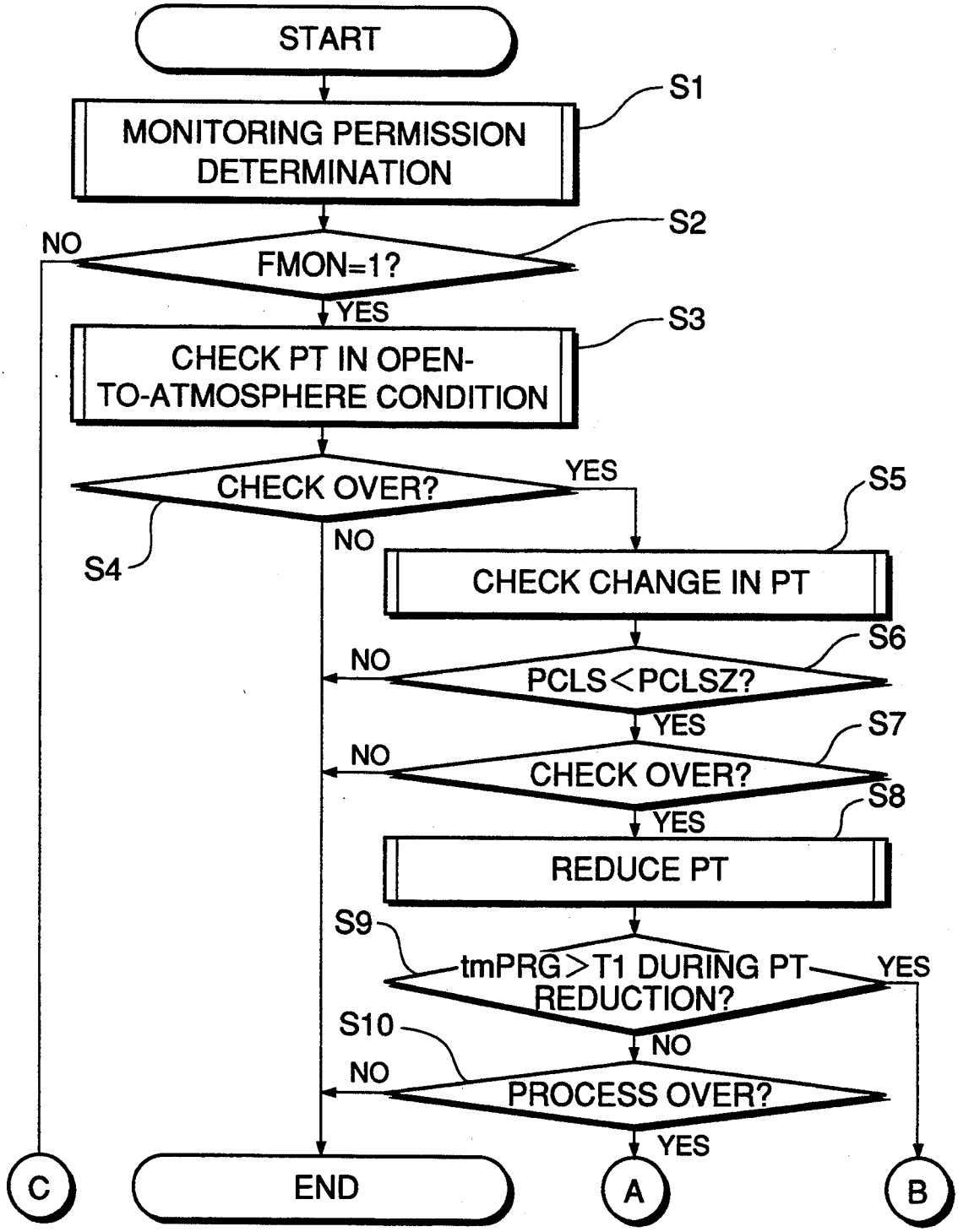
FIG. 3 is a flowchart showing a main program for carrying out determination of abnormality in an evaporative emission control system appearing in FIG. 1, according to the invention.
Figure 4:
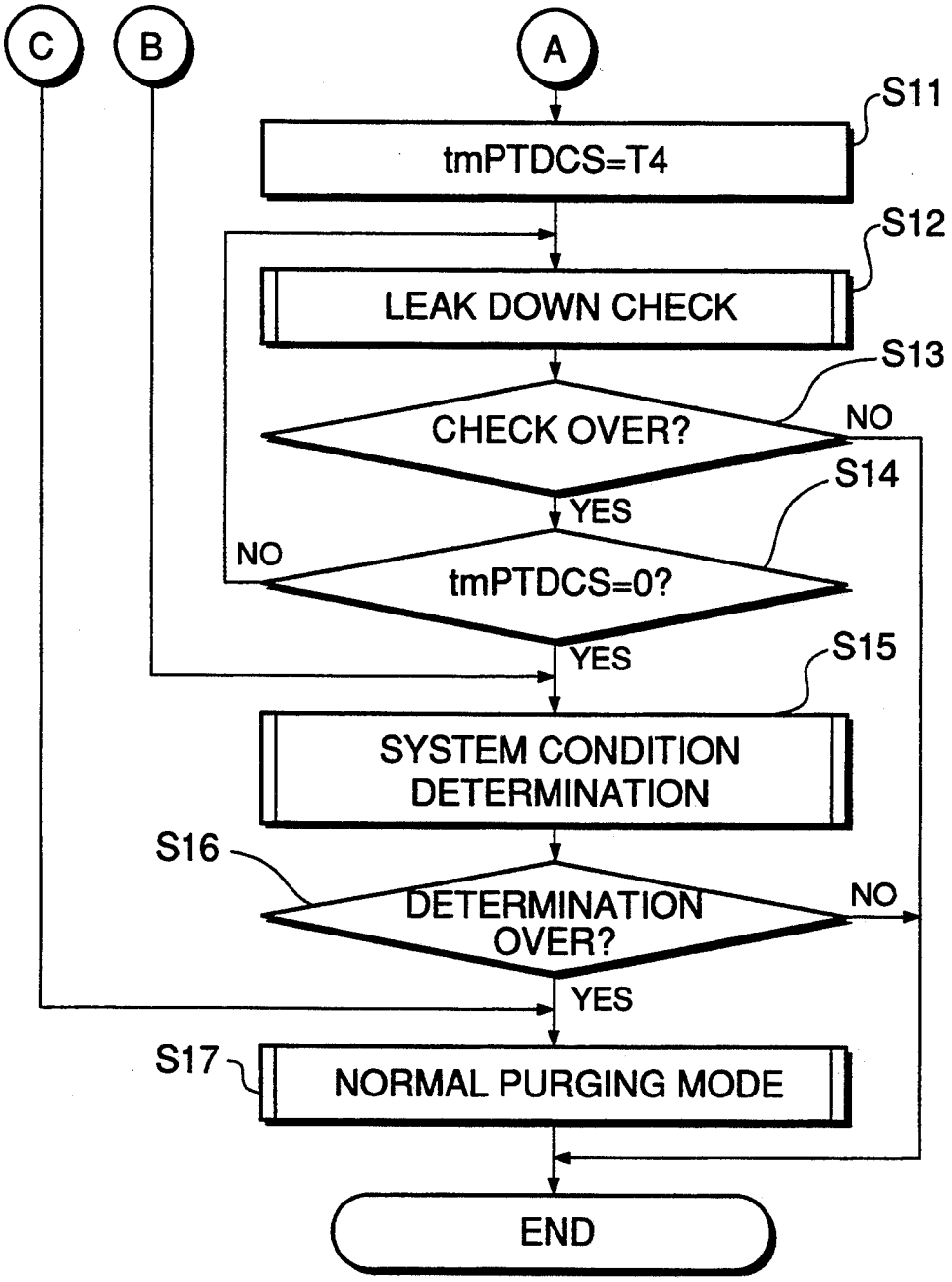
FIG. 4 is a latter portion of the flowchart in FIG. 3.

FIGS. 3 and 4 show a program for carrying out the abnormality detection of the evaporative control system 11, which is executed by the CPU of the ECU 5.

First, at a step S1, a routine of determining permission for monitoring (determination of fulfillment of abnormality determining conditions) is carried out, as described hereinafter. Then, at a step S2, it is determined whether or not the monitoring of the system 11 for abnormality detection is permitted, i.e. a flag FMON is set to "1". If the answer to this question is negative (NO), the first to third control valves 28, 36, 40 are set to respective operative states for normal purging mode of the system as mentioned before, followed by terminating the program, whereas if the answer to this question is affirmative (YES), the tank internal pressure PT in the open-to-atmosphere condition of the system is checked at a step S3, and it is determined at a step S4 whether or not this check has been completed. If the answer to this question is negative (NO), the program is immediately terminated, whereas if it is affirmative (YES), the first electromagnetic valve 35 is turned off to check a change in the tank internal pressure PT, by measuring a value PCLS of the tank internal pressure upon the lapse of a predetermined time period after turning-off of the first electromagnetic valve 35, at a step S5.

Figure 5:
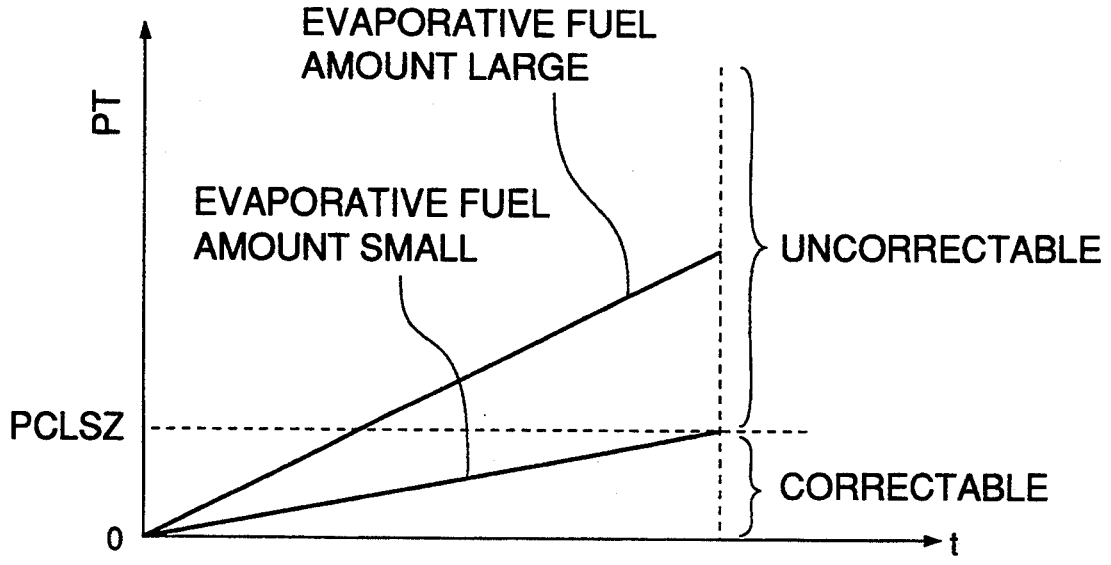
FIG. 5 is a diagram showing changes in the tank internal pressure with the lapse of time depending upon an amount of evaporative fuel in a fuel tank in FIG. 1, during a check of change in pressure within the tank.

Further, at a step S6, it is determined whether or not the measured PCLS value is larger than a predetermined value PCLSZ which is set corresponding to a limit value shown in FIG. 5 above which the aforementioned time period correction processing should not be carried out. If the answer to the question is affirmative (YES), i.e. if the PCLS value is larger than the predetermined value PCLSZ, it is determined that the amount of evaporative fuel generated within the tank is too large to accurately carry out the correction processing, followed by immediately terminating the present program. If the answer to the question of the step S6 is negative (NO), i.e. the PCLS value is smaller than the predetermined value PCLSZ, it is determined that the tank internal pressure is within a range where the correction processing can be carried out, followed by determining at a step S7 whether or not a check of a change in the tank internal pressure has been completed. If the answer to the question is negative (NO), the program is immediately terminated, whereas if it is affirmative (YES), the program proceeds to a step S8, where the first to third control valves 28, 36 and 40 are respectively operated to carry out negative pressurization of the emission control system 11 inclusive of the fuel tank 23.

Simultaneously with the start of the negative pressurization at the step S8, a first timer tmPRG incorporated in the ECU 5 is started, and it is determined at a step S9 whether or not the count value thereof is larger than a value corresponding to a predetermined time period T1. The predetermined time period T1 is set to such a value as ensures that the system 11 is negatively pressurized to a predetermined pressure value within the predetermined time period T1, i.e. the negatively pressurized condition of the system 11 is established within the predetermined time period T1, if the system is normal. If the answer to the question of the step S9 is affirmative (YES), it is determined that the system 11 cannot be negatively pressurized to the predetermined pressure value due to a hole formed in the fuel tank 23, or the like, and then the program proceeds to a step S15. On the other hand, if the answer to the question of the step S9 is negative (NO), it is determined at a step S10 whether or not the negative pressurization has been completed, i.e. the negatively pressurized state of the system 11 is established. If the answer to this question is negative (NO), the program is immediately terminated, whereas if it is affirmative (YES), the program proceeds to a step S11 in FIG. 4, where a fourth timer tmPTDCS for correcting an after-leak down check time period is set to a predetermined time period T4. That is, the time period T4 for correction is calculated in response to operating conditions of the fuel tank 23 (fuel amount, tank internal pressure value, and negatively pressurizing time period), and the execution of abnormality determination, described hereinafter, is delayed by the correcting time period T4.

More specifically, the correcting time period T4 is calculated by using the following equation (2):

$$T4=\Delta TTF+\Delta TVF+\Delta TPTO+\Delta TtmPTD \quad (2)$$

where ΔTTF represents a fuel temperature-correcting time period, which is calculated by retrieving a ΔTTF map stored in a memory means beforehand. In the ΔTTF map, map values ΔTTF0 to ΔTTF3 are allotted to fuel temperatures TF0 to TF3, respectively, and the ΔTTF values are read by retrieving the ΔTTF map, and if required, calculated by interpolation.

ΔTVF represents a fuel amount-correcting time period, which is calculated by retrieving a ΔTVF map stored in the memory means beforehand. In the ΔTVF map, map values ΔTVF0 to ΔTVF3 are allotted to fuel amounts within the fuel tank 23 VF0 to VF3, respectively, and the ΔTVF values are read by retrieving the ΔTVF map, and if required, calculated by interpolation.

ΔTPTO represents a tank internal pressure-correcting time period, which is calculated by retrieving a ΔTPTO map stored into the memory means beforehand. In the ΔTPTO map, map values ΔTPTO0 to ΔTPTO3 are allotted to tank internal pressure values PTO0 to PTO3, respectively, and the ΔTPTO values are read by retrieving the ΔTPTO map, and if required, calculated by interpolation.

ΔTtmPTD represents a negative pressurization-correcting time period, which is calculated by retrieving ΔTtmPTD map stored into the memory means beforehand. In the ΔTtmPTD map, map values ΔTtmPTD0 to ΔTtmPTD3 are allotted to negatively pressurizing time periods tmPTD0 to tmPTD3, and the ΔTtmPTD values are read by retrieving the ΔTtmPTD map, and if required, calculated by interpolation.

The correcting time periods ΔTTF, ΔTVF, ΔTPT and ΔTtmPTD are respectively set to large values according to the fuel temperature TF, the fuel amount VF, the tank internal pressure PT, and the negatively pressurizing time period tmPTD.

Next, at a step S12, it is determined whether or not leakage of evaporative fuel has occurred from the emission control system 11, by a leak down check routine, described hereinbelow, and it is determined at a step S13 whether or not the check has been completed.

If the answer to the question is negative (NO), the program is terminated, whereas if the answer is affirmative (YES), the program proceeds to a step S14, where it is determined whether or not a timer tmPTDCS set to the predetermined time period (correcting time period) T4 has counted the set value, and if the answer is negative (NO), i.e. if the predetermined time period T4 has not elapsed from the start of setting the timer, the program returns to the step S12, where the leak down check is continued. If the answer to the question of the step S14 is affirmative (YES), i.e. if the count value thereof is larger than the value corresponding to the predetermined time period T4, it is determined that the correction processing has been completed, followed by program proceeding to a step S15.

At the step S15, determination of conditions of the emission control system 11 is carried out, followed by determining at a step S16 whether or not the determination has been completed. If the answer is negative (NO), the program is terminated, whereas if the answer is affirmative (YES), the emission control system 11 is set to the normal purging mode at a step S17, followed by terminating the program.

Next, the individual steps of the main routine of FIGS. 3 and 4 will be described.

(1) Determination of Permission for Monitoring (at the step S1 in FIG. 3)

When the engine coolant temperature TWI detected by the TW sensor 15 at the start of the engine is below a predetermined value TWX, the coolant temperature TW detected after the start of the engine falls within a range between a predetermined lower limit value TWL (e.g. 50° C.) and a predetermined upper limit value TWH (e.g. 90° C.), and at the same time the intake air temperature detected by the TA sensor 14 falls within a range between a predetermined lower limit value TAL (e.g. 70° C.) and a predetermined upper limit value TAH (e.g. 90° C.), it is determined that the engine has been warmed up, and then determination is carried out as to whether the monitoring is to be permitted.

Further, when the engine rotational speed NE detected by the NE sensor 16 is within a range between a predetermined lower limit value NEL (e.g. 2000 rpm) and a predetermined upper limit value NEH (e.g. 4000 rpm), when the intake pipe absolute pressure PBA detected by the PBA sensor 13 is within a range between a predetermined lower limit value PBAL (e.g. −350 mmHg) and a predetermined upper limit value PBAH (e.g. −150 mmHg), the throttle valve opening θTH detected by the θTH sensor 4 is within a range between a predetermined lower limit value θTHL (e.g. 1 degree) and a predetermined upper limit value θTHH (e.g. 5 degrees), and at the same time the vehicle speed VSP detected by the VSP sensor 21 is within a range between a predetermined lower limit value VSPL (e.g. 53 km/hr) and a predetermined upper limit value VSPH (e.g. 61 km/hr), it is determined that the engine is in a stable operating condition. Further, when these monitoring-permitting conditions are satisfied, the flag FMON is set to "1" to permit the monitoring of abnormality detection, followed by terminating the program.

(2) Check of Tank Internal Pressure in Open-To-Atmosphere Condition (at the step S3 in FIG. 3)

First, the emission control system 11 is set to the open-to-atmosphere mode, and at the same time a second timer tmATMP is reset and started. More specifically, the first electromagnetic valve 35 is held in the energized state, and at the same time the second electromagnetic valve 39 is held in the deenergized state to keep the drain shut valve 38 open. Further, the purge control valve 36 is kept open. Thus, the tank internal pressure PT is relieved to the atmosphere (see the time period (2) in FIG. 2).

Further, when the count value of the second timer tmATMP is larger than a value corresponding to a predetermined time period T2 (where the time period T2 is set to a value, e.g. 4 sec, which ensures that the pressure within the system 11 has been stabilized upon or before lapse thereof), the tank internal pressure PATM in the open-to-atmosphere condition is detected by the PT sensor 29 and stored into the ECU5. Then, a check-over flag is set, followed by terminating the program.

(3) Check of A Change in Tank Internal Pressure (at the step S5 in FIG. 3)

First, the emission control system 11 is set to a PT change-checking mode, and at the same time a third timer tmTP is reset and started. More specifically, while the purge control valve 36 and the drain shut valve 38 are held open, the first electromagnetic valve 35 is turned off to thereby set the system to the PT change-checking mode (see the time period (3) in FIG. 2).

When the count value of the third timer tmTP is larger than a value corresponding to a predetermined time period T3 (e.g. 10 sec), a tank internal pressure value PCLS after the lapse of the predetermined period T3 is measured and stored into the ECU5, followed by calculating a first rate of change in the tank internal pressure PVARIA, by using the following equation (3):

$$PVARIA=(PCLS-PATM)/T3 \quad (3)$$

Then, the first rate of change PVARIA thus calculated is stored into the ECU5 and a check-over flag is set, followed by terminating the program.

(4) Negative Pressurization (at the step S8 in FIG. 3)

The emission control system 11 is set to a negatively-pressurizing mode. More specifically, the purge control valve 36 is kept open, and at the same time the first electromagnetic valves 35 is turned on, and the second electromagnetic valve is turned on to close the drain shut valve 38 (see the time period (4) in FIG. 2). In this state, the system 11 is negatively pressurized to a predetermined value by a gas-drawing force created by operation of the engine 1. When a tank internal pressure value PCHK during the negative pressurization is increased to a predetermined negative pressure value P1 (e.g. −20 mHG) or more, a process-over flag is set, followed by terminating the program.

(5) Leak Down Check (at the step S12 in FIG. 4)

The system 11 is set to a leak down check mode. More specifically, while the first electromagnetic valve 35 is held in the energized state and at the same time the drain shut valve 38 is kept closed, the purge control valve 36 is closed to cut off the communication between the system 11 and the intake pipe 2 of the engine 1 (see time the period 5 in FIG. 2).

In a loop of the first execution of the program, a tank internal pressure PST is measured, and a fourth timer tmLEAK is reset and started.

In a subsequent loop when the count value of the fourth timer tmLEAK becomes larger than a value corresponding to a predetermined time period T5, the present tank internal pressure value PEND at the end of the leak down check is detected and stored into the memory means of the ECU 5, followed by calculation of a second rate of change PVARIB in the tank internal pressure PT by the use of the following equation (4):

$$PVARIB=(PEND-PST)/T4 \quad (4)$$

The second rate of change PVARIB in the tank internal pressure PT thus calculated is stored into the memory means of the ECU 5, and a check-over flag is set, followed by terminating the program.

(6) System Condition-Determining Process (at the step S15 in FIG. 4)

Figure 6:
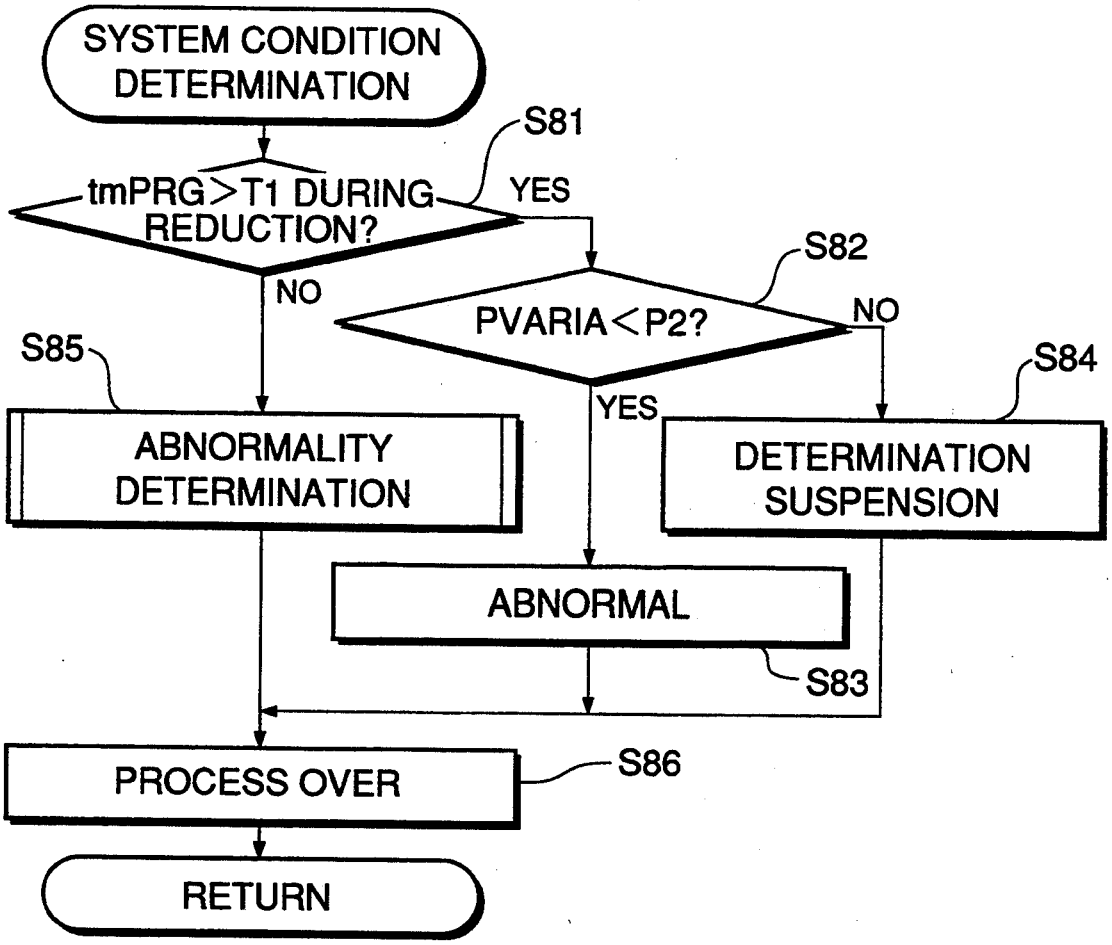
FIG. 6 is a flowchart showing a routine for determining a system condition.

FIG. 6 shows a routine for carrying out a process of determining a condition of the system 11, which is executed as a background processing.

First, at a step S81, it is determined whether or not the count value of the first timer tmPRG has exceeded the value corresponding to the predetermined value T1 during the negatively-pressurizing process. If the answer to this question is affirmative (YES), it is determined that the system 11 may suffer from a significant leak of evaporative fuel due to a hole formed in the fuel tank 23 or the like, so that the program proceeds to a step S82, where is determined whether or not the first rate of change PVARIA in the tank internal pressure PT is smaller than a predetermined value P2. If the answer to this question is affirmative (YES), which means that the rate of rise in the tank internal pressure PT was low during the check of a change in the tank internal pressure PT, it is determined that the system 11 suffers from a significant leak of evaporative fuel from the fuel tank 23, and/or piping connections, etc., determining that the evaporative control system 11 is abnormal (step S83), and then a process-over flag is set at a step S86, followed by terminating the program. On the other hand, if the answer to the question of the step S82 is negative (NO), which means that evaporative fuel was generated in a large amount in the fuel tank 23 to increase the tank internal pressure PT, i.e., the tank internal pressure PCLS obtained upon the lapse of the predetermined time T3 after turning-off of the first electromagnetic valve 35 is smaller than the predetermined valve PCLSZ, which prevented the system 11 from being negatively pressurized in a proper manner in the negatively-pressurizing process, the determination of the system condition is suspended at a step S84, and then the process-over flag is set at a step S86, followed by terminating the program.

On the other hand, if the answer to the question of the step S81 is negative (NO), i.e. if the system 11 was negatively pressurized to the predetermined value, the program proceeds to a step S85, where a predetermined determination routine after negative pressurization is carried out, and a process-over flag is set at a step S86, followed by terminating the program.

Figure 7:
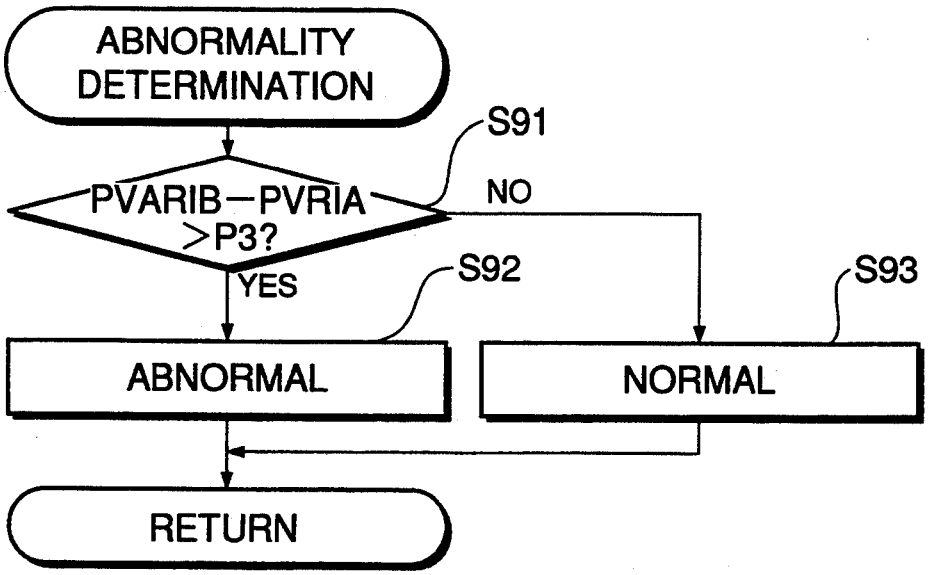
FIG. 7 is a flowchart showing a routine for determining abnormality.

Details of the determination routine carried out at the step S85 will be described with reference to a flowchart shown in FIG. 7.

It is determined whether or not the difference between the second rate of change PVARIB and the first rate of change PVARIA is larger than a predetermined value P3, in order to determine whether the second rate of change PVARIB is due to a leak from the evaporative control system 11 or due to the amount of evaporative fuel generated within the fuel tank 23. More specifically, when the second rate of change PVARIB is large due to a large amount of evaporative fuel generated within the fuel tank 23, the answer to the question of a step S91 becomes negative (NO). On the other hand, when the second rate of change PVARIB is large due to a large amount of leakage from the emission control system 11 to the outside, the answer to the question of the step S91 becomes affirmative (YES). The predetermined value P3 is set according to the negatively pressurizing time period TR (=time period (4) in FIG. 2). When the answer to the question of the step S91 is affirmative (YES), that is, when the difference between the second rate of change PVARIB and the first rate of change PVARIA is larger than the predetermined value P3, it is determined at a step S92 that the emission control system 11 is abnormal, whereas, when the answer to the question of the step S91 is negative (NO), it is determined at a step S93 that the emission control system 11 is normal, followed by terminating the program.

(7) Normal Purging (at the step S17 in FIG. 4)

The first electromagnetic valve 35 is held in the energized state, and the drain shut valve 39 and the purge control valve 36 are opened to thereby set the system to the normal purging mode where air drawing from the engine 1 is enabled. Then, the present program is terminated.

Figure 8:
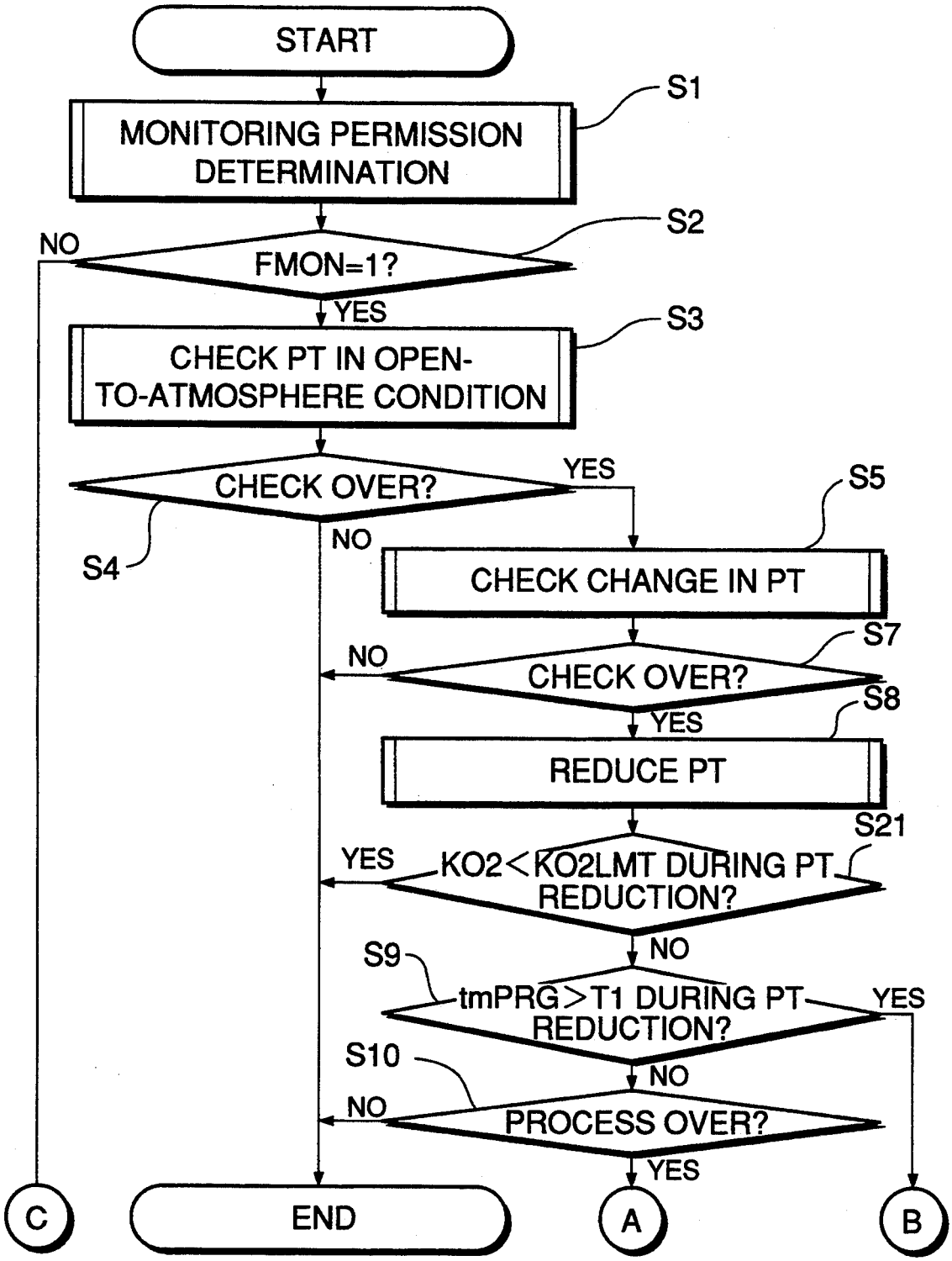
FIG. 8 is a flowchart showing a main program for carrying out determination of abnormality according to a second embodiment of the invention.
Figure 9:
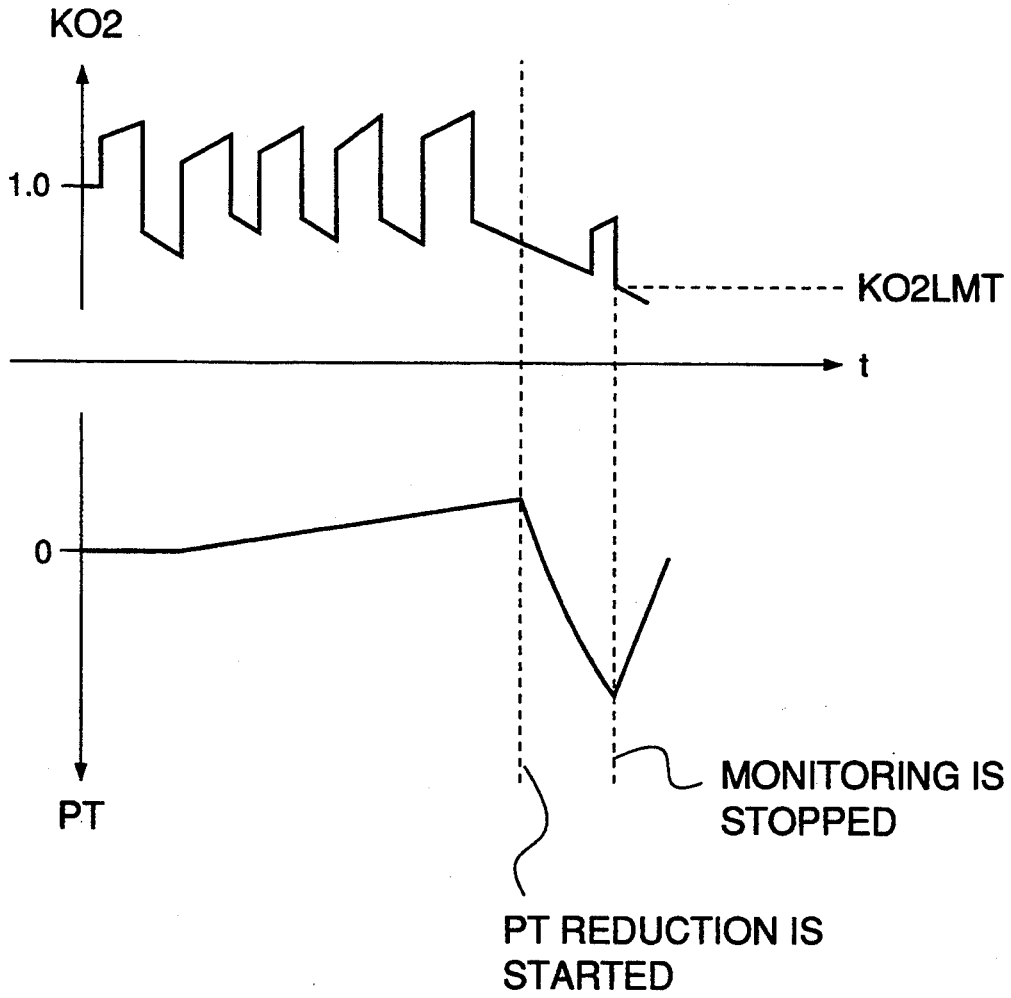
FIG. 9 is a diagram showing a change of an air-fuel ratio correction coefficient KO2 during negative pressurization.

FIG. 8 shows an abnormality diagnosing method carried out by the evaporative fuel-processing system according to a second embodiment of the invention. To simplify the description, in FIG. 8 corresponding steps to those in FIG. 3 are designated by identical reference numerals, and description thereof is omitted. Further, steps following the connection symbols A, B and C are the same as those in FIG. 4, and therefore illustration thereof is omitted.

In the first embodiment described hereinbefore, the determination as to whether or not the PCLS value is larger than the predetermined value PCLSZ during the check of a change in the tank internal pressure is carried out to detect the amount of evaporative fuel generated within the fuel tank 23. On the other hand, in the present embodiment, it is determined whether or not the air-fuel ratio correction coefficient KO2 is smaller than a predetermined value KO2LMT during the negative pressurization, to thereby detect the amount of evaporative fuel generated within the fuel tank 23.

In the flowchart of FIG. 8, during negative pressurization within the fuel tank carried out at a step S8, it is determined whether or not the air-fuel ratio correction coefficient KO2 becomes smaller than the predetermined value KO2LMT at a step S21. If the answer to the question is affirmative (YES), i.e. when the KO2 value becomes smaller than the predetermined value KO2LMT during the negative pressurization, the abnormality determination is terminated. That is, during the negative pressurization within the tank, the KO2 value can become smaller than the predetermined value KO2LMT when an extremely large amount of evaporative fuel is generated within the fuel tank so that a large amount of evaporative fuel is stored in the absorbent 24 within the canister 26. In the conventional system, the negative pressurization is continued even in such a situation, resulting in evaporative fuel being directly drawn into the intake system of the engine due to vacuum developed therein. As a result, an extremely enriched air-fuel mixture is supplied to the engine, thereby causing an adverse effect on the driveability and exhaust emission characteristics of the engine. Further, if the negative pressurization within the fuel tank is continued when the canister 26 is thus filled with evaporative fuel, the canister acts as a large resistance to the drawing force caused by vacuum in the intake pipe 2 to prevent the tank internal pressure from being reduced to a desired negative pressure value, whereby if the program of FIG. 6 is applied, the answer to the question of the step S81 becomes affirmative (YES), so that although an extremely large amount of evaporative fuel is generated with no leakage 30 occurring in the fuel tank, a misjudgment that leakage has occurred can be rendered (step S83), or the abnormality determination is suspended (step S84), depending on the condition of the fuel tank.

By contrast, according to the present embodiment, when the KO2 value becomes smaller than the predetermined value KO2LMT at the step S21, it is determined that the driveability or exhaust emission characteristics can be degraded, or a misjudgment that leakage has occurred can be made, and then the abnormality detection of the emission control system 11 is immediately terminated. Therefore, not only degraded driveability or degraded exhaust emission characteristics can be prevented, but also the system determination processing in FIG. 6 is inhibited as mentioned above, to thereby prevent the above-mentioned inconveniences.

What is claimed is:

1. In an evaporative fuel-processing system for an internal combustion engine in a vehicle and having an intake system, and a fuel tank, said evaporative fuel-processing system including an evaporative emission control system comprising a canister having an air inlet port communicating with the atmosphere, an evaporative fuel-guiding passage extending between said canister and said fuel tank, a purging passage extending between said canister and said intake system, a purge control valve arranged across said purging passage for controlling opening thereof, a drain shut valve arranged across said inlet port of said canister, control means for controlling operations of said purge control valve and said drain shut valve, and abnormality detecting means for detecting abnormality in said evaporative emission control system and said fuel tank while operations of said purge control valve and said drain shut valve are controlled by said control means, the improvement comprising, evaporative fuel amount detecting means for detecting an amount of evaporative fuel generated within said fuel tank; and abnormality detection inhibiting means for inhibiting abnormality detection by said abnormality detecting means when the amount of evaporative fuel generated within said fuel tank detected by said evaporative fuel amount detecting means exceeds a predetermined value.

2. An evaporative fuel-processing system as claimed in claim 1, wherein said evaporative fuel amount detecting means detects the amount of said evaporative fuel generated within said fuel tank, based on a change in pressure within at least one of said fuel tank and said evaporative emission control system.

3. An evaporative fuel-processing system as claimed in claim 1, wherein said abnormality detecting means includes open-to-atmosphere setting means for bringing the interior of said evaporative control system and said fuel tank into a state open to the atmosphere, and pressure checking means for closing a region including at least said fuel tank after said evaporative control system and said region have been brought into said open state and for checking a change in pressure within said region while said region is closed, the amount of said evaporative fuel generated within said fuel tank being detected based on the checked change in pressure within said region.

4. In an evaporative fuel-processing system for an internal combustion engine in a vehicle and having an intake system, and a fuel tank, said evaporative fuel-processing system including an evaporative emission control system comprising a canister having an air inlet port communicating with the atmosphere, an evaporative fuel-guiding passage extending between said canister and said fuel tank, a purging passage extending between said canister and said intake system, a purge control valve arranged across said purging passage for controlling opening thereof, a drain shut valve arranged across said inlet port of said canister, control means for controlling operations of said purge control valve and said drain shut valve, and abnormality detecting means for detecting abnormality in said evaporative emission control system and said fuel tank while operations of said purge control valve and said drain shut valve are controlled by said control means, the improvement comprising, evaporative fuel amount detecting means for detecting an amount of evaporative fuel generated within said fuel tank; and abnormality detection inhibiting means for inhibiting abnormality detection by said abnormality detecting means when the amount of evaporative fuel generated within said fuel tank detected by said evaporative fuel amount detecting means exceeds a predetermined value, wherein said abnormality detecting means includes negative pressurization means responsive to a command from said control means for bringing at least one of said evaporative emission control system and said fuel tank into a predetermined negatively pressurized state by controlling operations of said purge control valve and said drain shut valve, said abnormality detection inhibiting means inhibiting execution of said negative pressurization means when the amount of said evaporative fuel generated within said fuel tank detected by said evaporative fuel amount detecting means exceeds said predetermined value.

5. An evaporative fuel-processing system as claimed in claim 4, wherein said abnormality detecting means includes pressure change detecting means for detecting a change in pressure within said at least one of said evaporative emission control system and said fuel tank, after said at least one of said evaporative emission control system and said fuel tank have been brought into said predetermined negatively pressurized state.

6. In an evaporative fuel-processing system for an internal combustion engine in a vehicle and having an intake system, and a fuel tank, said evaporative fuel-processing system including an evaporative emission control system comprising a canister having an air inlet port communicating with the atmosphere, an evaporative fuel-guiding passage extending between said canister and said fuel tank, a purging passage extending between said canister and said intake system, a purge control valve arranged across said purging passage for controlling opening thereof, a drain shut valve arranged across said inlet port of said canister, control means for controlling operations of said purge control valve and said drain shut valve, and abnormality detecting means for detecting abnormality in said evaporative emission control system and said fuel tank while operations of said purge control valve and said drain shut valve are controlled by said control means, the improvement comprising, evaporative fuel amount detecting means for detecting an amount of evaporative fuel generated within said fuel tank; and abnormality detection inhibiting means for inhibiting abnormality detection by said abnormality detecting means when the amount of evaporative fuel generated within said fuel tank detected by said evaporative fuel amount detecting means exceeds a predetermined value, wherein said engine includes an exhaust system, and oxygen concentration detecting means for detecting concentration of oxygen in exhaust gases in said exhaust system, the amount of said evaporative fuel generated within said fuel tank being detected in accordance with said concentration of oxygen detected by said oxygen concentration detection means, when said purging passage is opened by said purge control valve controlled by said control means.

7. An evaporative fuel-processing system as claimed in claim 3, wherein said region comprises said fuel tank and a part of said evaporative fuel-guiding passage.

8. In an evaporative fuel-processing system for an internal combustion engine in a vehicle and having an intake system, and a fuel tank, said evaporative fuel-processing system including an evaporative emission control system comprising a canister having an air inlet port communicating with the atmosphere, an evaporative fuel-guiding passage extending between said canister and said fuel tank, a purging passage extending between said canister and said intake system, a purge control valve arranged across said purging passage for controlling opening thereof, a drain shut valve arranged across said inlet port of said canister, control means for controlling operations of said purge control valve and said drain shut valve, and abnormality detecting means for detecting abnormality in said evaporative emission control system and said fuel tank while operations of said purge control valve and said drain shut valve are controlled by said control means, the improvement comprising, evaporative fuel amount detecting means for detecting an amount of evaporative fuel generated within said fuel tank; and abnormality detection inhibiting means for inhibiting abnormality detection by said abnormality detecting means when the amount of evaporative fuel generated within said fuel tank detected by said evaporative fuel amount detecting means exceeds a predetermined value, wherein said abnormality detecting means includes open-to-atmosphere setting means for bringing the interior of said evaporative control system and said fuel tank into a state open to the atmosphere, and pressure checking means for closing at least said fuel tank after said evaporative control system and said fuel tank have been brought into said open state and for checking a change in pressure within said fuel tank while said fuel tank is closed, the amount of said evaporative fuel generated within said fuel tank being detected based on the checked change in pressure within said fuel tank.

* * * * *